US005816511A

United States Patent [19]

Bernardi et al.

[11] Patent Number: 5,816,511

[45] Date of Patent: Oct. 6, 1998

[54] CYLINDER-TYPE MACHINE FOR MILLING SEED AND GRAIN HAVING A DEVICE WITH A SINGLE AXIS OF ROTATION FOR ADJUSTING THE INTERAXIAL DISTANCE OF THE CYLINDERS

[75] Inventors: Bernardino Bernardi, Quinto di Treviso; Cesare Roberti, Vedelago, both of Italy

[73] Assignee: Berga S.p.A., Italy

[21] Appl. No.: 584,797

[22] Filed: Jan. 11, 1996

[30] Foreign Application Priority Data

Mar. 27, 1995 [IT] Italy ..... MI95 A 000609

[51] Int. Cl.[6] ..... B02C 4/38

[52] U.S. Cl. ..... 241/230; 241/290

[58] Field of Search ..... 241/230–234, 241/286, 287, 288, 289, 290; 72/240, 243.2, 241.6; 100/168, 169, 170, 171

[56] References Cited

U.S. PATENT DOCUMENTS 4,339,083 7/1982 Linzberger et al. ..... 241/234

FOREIGN PATENT DOCUMENTS 0429658 6/1991 European Pat. Off. .
0598705 5/1994 European Pat. Off. .
2358195 2/1978 France .
8601128 2/1986 WIPO .
9313857 7/1993 WIPO .

*Primary Examiner*—Mark Rosenbaum
*Attorney, Agent, or Firm*—Ladas & Parry

[57] ABSTRACT

Machine for milling cereals and the like of the type comprising at least one pair of cylinders (2, 3) rotating about respective axes of rotation, one of which is fixed and one movable in translation with respect to the other, each end of the movable cylinder (3) being connected to a support member (5), the opposite ends of which are respectively pivotably mounted on a device (20) for adjusting the interaxial distance of the cylinders (2, 3), acting about a single fixed axis of rotation, and on a device (10) for absorbing the reaction forces of the milling operation, to which the upper part (2*b*) of the member (2*a*) supporting the fixed cylinder (2) is also connected.

7 Claims, 3 Drawing Sheets

12a
II
11
5c
10
2b
5d
5b
2
3
4
5
2a
21
26
26a
21a
6
22
1
23
II
20
24

Fig.4a
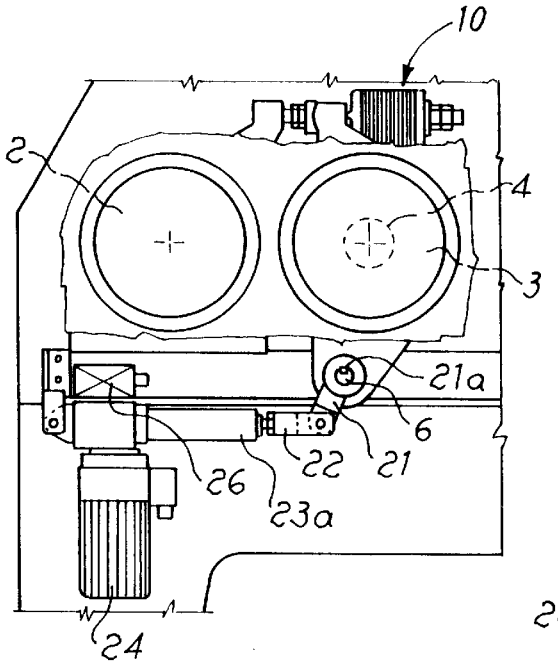
Fig.4b
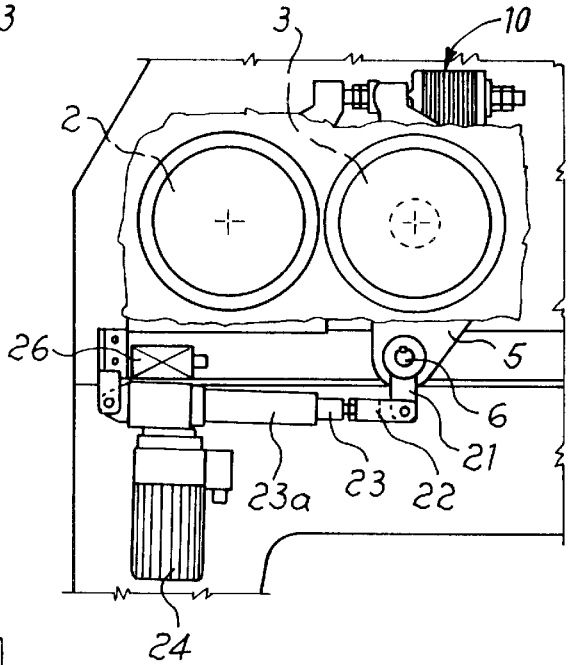
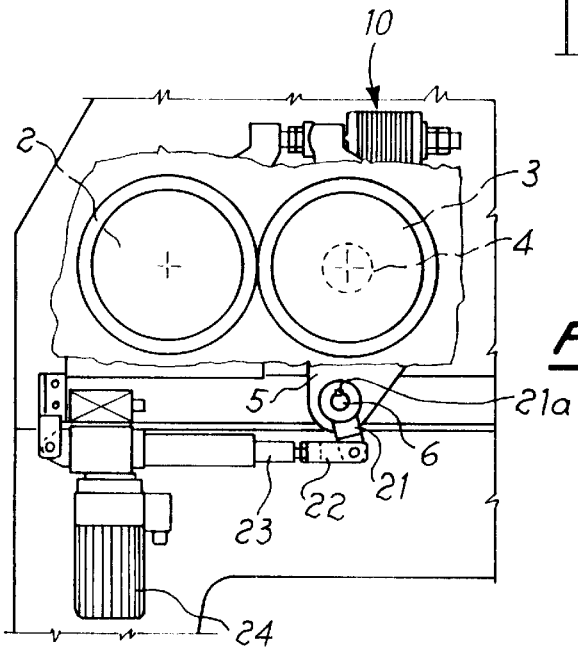
Fig.4c

CYLINDER-TYPE MACHINE FOR MILLING SEED AND GRAIN HAVING A DEVICE WITH A SINGLE AXIS OF ROTATION FOR ADJUSTING THE INTERAXIAL DISTANCE OF THE CYLINDERS

This application claims priority from Italian patent application No. MI.95A 000609 filed Mar. 27, 1995. Said document is incorporated herein by reference.

The present invention relates to a machine for milling cereals and the like of the type comprising at least one pair of cylinders rotating about respective axes of rotation, one of which is fixed and one movable in translation with respect to the other, in which each end of the movable cylinder is connected to a device for adjusting the interaxial distance of the cylinders, acting about a single fixed axis of rotation.

In the technical sector relating to the milling of products in seed or grain form, such as cereals and the like, machines for milling the same are known, said machines being designed to transform the product from a granular form into a floury or powdery form of a predetermined particle size.

Said machines, which are referred to by the term rolling mills, are substantially based on the use of pairs of constant-section milling rollers, through which the product is made to pass in order to perform milling thereof.

For this purpose, said pairs of rollers must be maneuverable so as to be able to obtain the parallel alignment of the same and be able to adjust their mutual position from a so-called open-cylinder position, substantially corresponding to the position where there is a maximum interaxial distance between them, to a working position, where the cylinders are close together, which position in turn can be precisely adjusted in relation to the greater or smaller size of the milled product which one wishes to obtain.

It is also known of devices for actuating one of the two cylinders with respect to the other, fixed, one, said devices, however, being bulky and imprecise and being based on separate actuating systems of the pneumatic type which, individually and independently of one another, perform the rapid movement for positioning the cylinders in their open and/or working configuration, or the subsequent fine adjustment of the interaxial distance for the actual milling operation.

These independent operating systems, acting on separate axes of rotation and lever mechanisms, require double the number of mechanical operating and control parts, with a consequent increase in the maintenance and the warehouse supplies necessary for any technical repair work.

The technical problem which is posed, therefore, is that of realizing a machine for milling cereals and the like of the type with pairs of milling cylinders, which is provided with a device for controlling and performing adjustment of the parallel alignment and the interaxial distance between the said cylinders, the said device having a simple and economical design and allowing one to perform both a rapid movement for positioning the cylinders in the open and working positions and the continuous adjustment of the distance between the axes of the cylinders so as to obtain adjustment of the milling operation in relation to the type of product and desired final particle size thereof, and also to take up any wear of the cylinders without the need for double the number of mechanical and operating components.

Within the scope of this problem, a further need is to realize a machine provided with a device which is able to absorb any milling reaction forces, due for example to the passage of foreign substances which have a hardness greater than that of the cereal being milled, said reaction forces being potentially the cause of damage to the cylinders and/or the machine.

These results are obtained according to the present invention by a machine for milling cereals and the like of the type comprising at least one pair of cylinders rotating about respective axes of rotation, one of which is fixed and one movable in translation with respect to the other, each end of the movable cylinder being connected to a support member, the opposite ends of which with respect to the axis of rotation are respectively pivotably mounted on a device for adjusting the interaxial distance of the cylinders, acting about a single fixed axis of rotation, and on a device for absorbing the reaction forces of the milling operation, to which the upper part of the member supporting the fixed cylinder is also connected, said combination performing the parallel alignment of the cylinders, rapid positioning of the same in a condition where there is a maximum interaxial distance or a predetermined working distance, and continuous adjustment of the interaxial distance corresponding to the said working position in relation to the specific type of milling operation programmed.

Further details will emerge from the following description, with reference to the accompanying drawings, in which:

FIGS. 4*a*, 4*b*, 4*c* show the positioning sequence of the cylinders in the open, working and contact positions, respectively.

Figure 1:
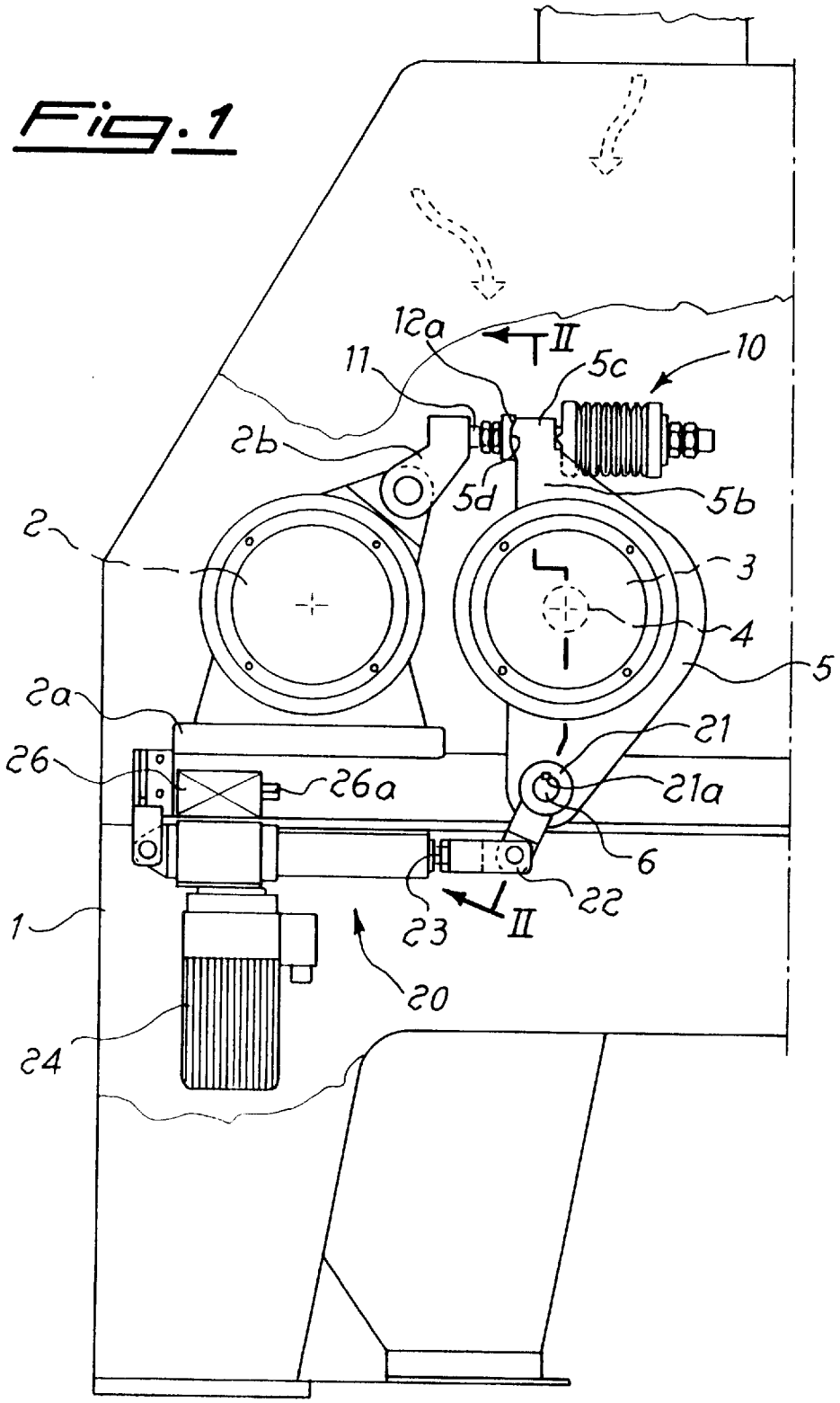
FIG. 1 shows a schematic side view of a rolling mill according to the invention.

As shown in FIG. 1, the rolling machine comprises substantially a support frame 1 on which there are mounted milling cylinders 2 and 3, each of which is made to rotate about its axis by known means. The axis of the cylinder 2 is kept fixed, while the axis of the cylinder 3 can be translated with respect to the axis of the cylinder 2; for the sake of simplicity of the description these parts will be referred to below as fixed cylinder 2 and movable cylinder 3.

Each opposite end of the fixed cylinder 2 is supported at the bottom via its own base-piece 2*a* integral with the frame 1 and connected at the top, via a flange 2*b*, to a first end of a device 10 for absorbing the milling overloads, described in detail below.

Figure 2:
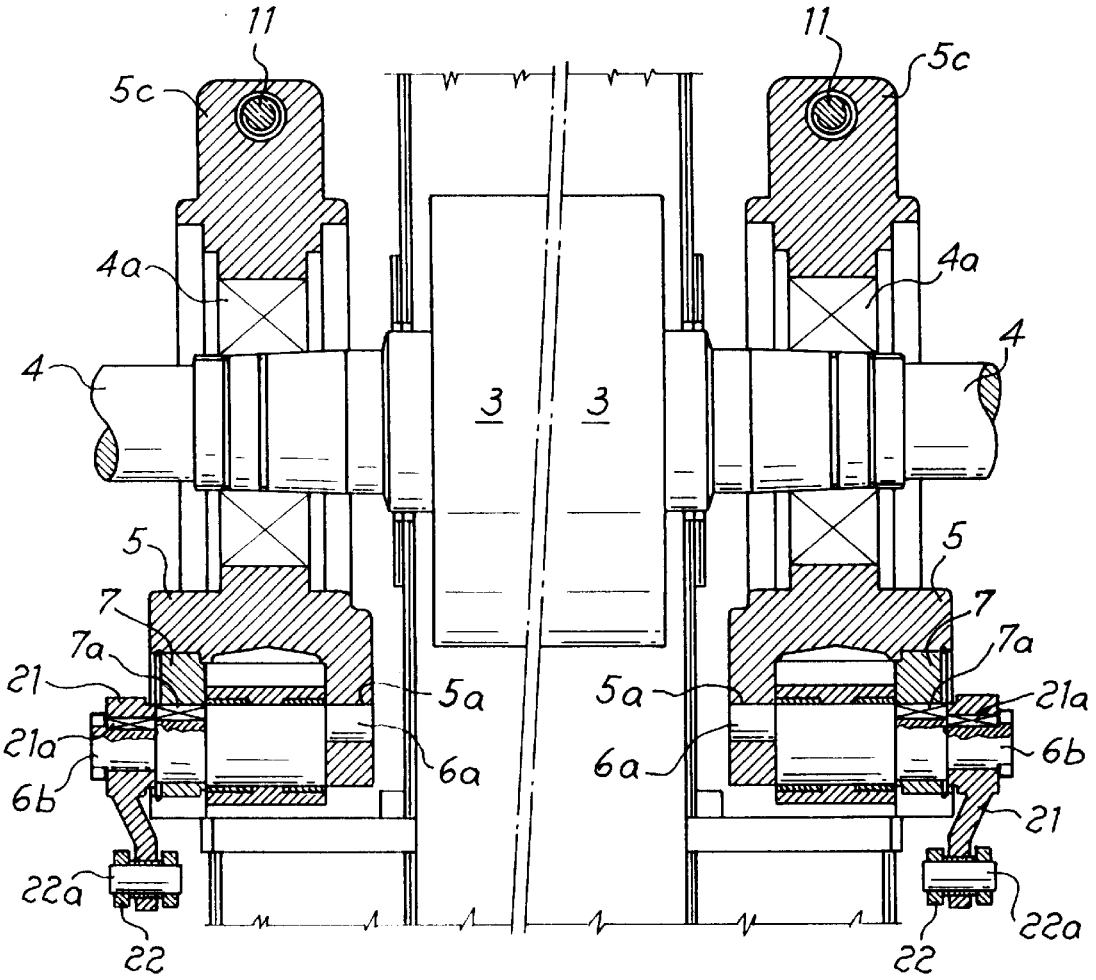
FIG. 2 shows a schematic section along the plane indicated by II—II in FIG. 1.

The movable cylinder 3 (FIGS. 2 and 3) is mounted on a shaft 4, the opposite ends of which are keyed onto a bearing 4*a* inserted inside a support 5, the upper end 5*b* of which is in the form of a tube 5*c*, the front surface 5*d* of which is rounded so as to allow rotation on the corresponding concave surface 12*a* of a retaining piece 12 attached to the rod 11 of the device 10 for absorbing the overloads.

Each support 5 of the movable cylinder 3 is also connected at the bottom, via a cam 6 arranged transversely with respect to the support 5 itself, to a device 20 for controlling and performing positioning of the movable cylinder itself.

More particularly, the cam 6 has an end 6*a* in the shape of a spigot which is housed in a respective seat 5*a* of the support 5 and the axis of which forms the axis of rotation of the cam 6 itself.

At the opposite end 6*b*, on the other hand, the cam is supported by a bush 7 with which it is constrained by means of a key 7*a* and the associated axis forms the fixed axis around which the cam 6 rotates.

The said end 6*b* of the cam is extended towards the outside of the support 5 by a certain amount suitable for coupling with a connecting rod 21, to which it is joined by means of a key 21*a*.

The end of the connecting rod 21, opposite to the cam 6, is connected, via a spigot 22*a*, to a fork-piece 22 forming the free end of an arm 23, in the form of an endless screw, which can be made to rotate in either direction by means of a gear motor 24. The entire assembly of gear motor 24 and arm 23 is hinged at 25 with the frame 1.

The control device 20 is completed by a position reader 26, the output 26*a* of which can be connected to electronic calculating and storage instruments, known per se and therefore not shown, designed to perform processing of the data for controlling and commanding positioning of the movable cylinder 3, as will be explained further hereinbelow with reference to FIGS. 4*a,c*.

Figure 3:
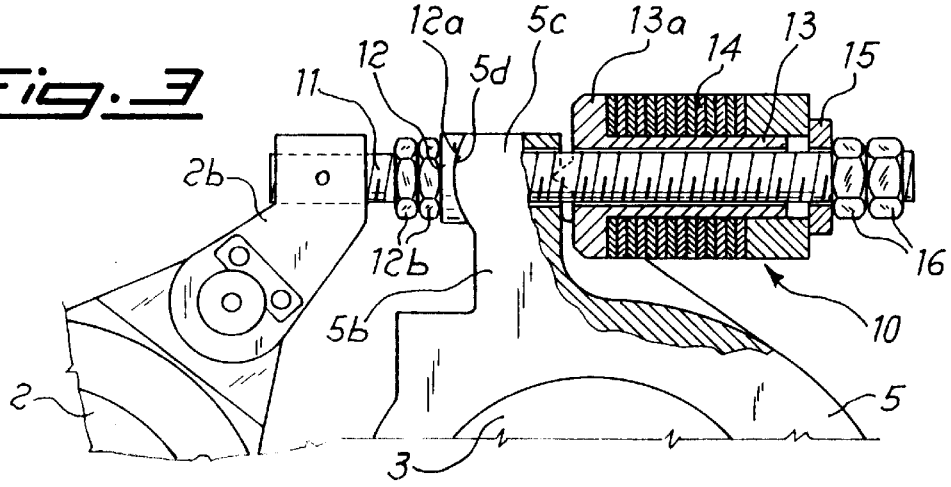
FIG. 3 shows a partially sectioned schematic view of the device for absorbing the overloads.

As illustrated in detail in FIG. 3, the aforementioned device 10 for absorbing the milling overloads substantially consists of the threaded rod 11, on which the aforementioned upper ends 2*b* and 5*b* of the supports 2*a* and 5 of the cylinders 2 and 3 are respectively inserted.

As shown in the enlarged detail of FIG. 3, the front surface of the support 5 is rounded so as to be able to rotate on a corresponding concave surface 12*a* of a contact piece 12 held in position by nuts 12*b* screwed onto the threaded rod 11.

On the same threaded rod 11, but on the opposite side with respect to said stop piece 12, there is mounted a damping device consisting of a tube 13 provided at one end with a disc 13*a* against which Belleville springs 14 are pressed, the latter being retained at the opposite end by a further disc 15 and by stop nuts 16.

In substance each opposite end of the movable cylinder 3 is connected to a support member connected to an actuating device 20 which is able to translate each said end both with respect to the other end of the same movable cylinder 3 and with the respect to the axis of the fixed cylinder 2.

Operation of the device (FIGS. 4*a*, 4*b*, 4*c*) is as follows:

firstly the two opposite actuating devices 20 are operated independently of one another so as to bring the movable cylinder 3 into contact with the fixed cylinder 2, and in this position the parallel alignment of the cylinders and the "zero" position taken as a reference for the subsequent translatory movements of the movable cylinder 3 are determined;

then the rolling mill is brought into the rest position where the arms 23 are fully retracted inside their seats 23*a* and hence the connecting rods 21 are totally rotated in the clockwise direction: with this configuration the pair of cylinders is in the so-called open position, i.e. with the maximum interaxial distance between the fixed cylinder 2 and the movable cylinder 3;

at the moment when milling is to be started, the program entered beforehand starts operation of the motors 24 so as to cause the rotation of the shafts 23 and the outward movement thereof from their seats, and consequently the rotation of the connecting rods 21 in an anti-clockwise direction, the latter in turn producing rotation of the cams 6 which cause rotation of the supports 5 about the upper end 5*c* inserted on the threaded rod 11 of the respective devices 10 for absorbing the overload; the outward movement of the arms 23 is stopped when the programming device reads, via the position reader 26, that the programmed distance between the axes of the cylinders 2 and 3 has reached the preset value in relation to the previously determined "zero" position;

finally, if required by the processing operation in progress, it is possible to make the connecting rods 21 perform a further rotation in order to cause a further rotation of the cams 6 which cause a further movement of the axes of the two cylinders towards one another until the external surfaces of the cylinders are in mutual contact or even in a so-called "negative-value" position, should it be necessary to compensate for any wear affecting either of the cylinders.

It is therefore obvious that it is advantageous to provide a cam with an eccentricity such as to cause, during the first section of angular rotation, a high rectilinear displacement of the cylinder 3 so as to pass rapidly from the open position into the working position and, during the second section of rotation, a very small displacement so as to allow precise adjustment of the distance between the two cylinders in accordance with that correspondingly programmed for the specific milling cycle.

It can be noted, moreover, that with the device according to the invention it is possible to actuate each of the opposite ends of the movable cylinder 3 independently of the other one, in order to restore the parallel alignment of the two cylinders disturbed during the course of milling, for example as a result of greater wear of one part of one cylinder compared to another part in the axial direction.

Many variants may be introduced with regard to the realization of the parts which make up the invention, without thereby departing from the protective scope of the present invention as defined in the claims which follow.

We claim:

1. A machine for milling seed and grain comprising at least one pair of rotating cylinders having one fixed cylinder and one movable cylinder, a first support connected to each end of said movable cylinder, one end of said first support being pivotably mounted to a device for adjusting the interaxial distance of the cylinders having a single axis of rotation and the other end being connected to a device for absorbing milling overloads, a second support connected to each end of said fixed cylinder, said second support also being connected to said device for absorbing milling overloads, so that said device for adjusting the interaxial distance and said device for absorbing milling overloads are capable of working in combination to perform parallel alignment of the cylinders, rapid adjustment of the interaxial distance of the cylinders and continuous adjustment of the interaxial distance of the cylinders to correspond to a programmed milling operation.

2. The machine according to claim 1, wherein said first support has an upper end in the form of a tube having a rounded front surface which permits said tube to rotate within a concave surface of a retaining piece attached to said device for absorbing milling overloads.

3. The machine according to claim 1 wherein the end of said first support opposite to the end connected to said device for absorbing milling overloads is joined to a cam, said cam further being fixed to one end of a connecting rod capable of rotating, said connecting rod further being connected on the opposite end to said device for adjusting the interaxial distance between the cylinders.

4. The machine according to claim 1 wherein said device for adjusting the interaxial distance between the cylinders comprises an arm which can be actuated in translation via a gear motor and having one end connected to a connecting rod and another end connected to a detection device designed to determine the instantaneous position of said arm.

5. The machine according to claim 4, wherein said arm is an endless screw.

6. The machine according to claim 1, wherein said device for absorbing milling overloads comprises a threaded rod having a damping device connected at one end and said first and second supports connected at the other end.

7. The machine according to claim 6 wherein said damping device comprises a tube having one end formed in a ring containing a resilient means and being retained on the opposite end by a disk locked in position by at least one nut screwed onto said threaded rod.

* * * * *